US005613335A

United States Patent [19]

Rennich et al.

[11] Patent Number: 5,613,335

[45] Date of Patent: Mar. 25, 1997

[54] PAPERBEAD FOR PROTECTING DRYWALL CORNERS

[75] Inventors: George Rennich; Roy Schouten, both of Edmonton; Florent Gilmore, Sherwood Park, all of Canada

[73] Assignee: British Steel Canada Inc., Montreal, Canada

[21] Appl. No.: 389,817

[22] Filed: Feb. 14, 1995

[51] Int. Cl.[6] ..... E04B 1/00

[52] U.S. Cl. ..... 52/255; 52/254; 52/741.4

[58] Field of Search ..... 52/254, 255, 741.4

[56] References Cited

U.S. PATENT DOCUMENTS

| | | | |
|---|---|---|---|
| 2,234,701 | 3/1941 | Lyman . | |
| 2,590,846 | 4/1952 | Cutting | 72/121 |
| 2,593,859 | 4/1952 | Dunlap . | |
| 2,851,741 | 9/1958 | Stemples | 52/255 |
| 2,862,264 | 12/1958 | Perna | 20/74 |
| 2,904,856 | 9/1959 | Robinson | 52/255 |
| 3,090,087 | 5/1963 | Miller . | |
| 3,109,207 | 11/1963 | Cooper . | |
| 4,624,087 | 11/1986 | Schneller | 52/254 |
| 4,722,153 | 2/1988 | Hardy | 52/254 X |
| 4,863,774 | 9/1989 | Tucker . | |
| 4,876,837 | 10/1989 | Kelly et al. . | |
| 4,977,718 | 12/1990 | Hoffman, Sr. . | |
| 5,037,686 | 8/1991 | Conboy . | |
| 5,048,247 | 9/1991 | Weldy . | |
| 5,058,354 | 10/1991 | Menchetti | 52/486 |
| 5,131,198 | 7/1992 | Ritchie et al. . | |
| 5,238,720 | 8/1993 | Volkman | 428/40 |
| 5,313,755 | 5/1994 | Koenig Jr. | 52/255 |
| 5,314,584 | 5/1994 | Grinnell et al. | 162/109 |
| 5,390,458 | 2/1995 | Menchetti | 52/417 |

FOREIGN PATENT DOCUMENTS

| | | |
|---|---|---|
| 153625 | 10/1953 | Austria . |
| 487518 | 10/1952 | Canada . |
| 553665 | 3/1958 | Canada . |
| 524111 | 4/1958 | Canada . |
| 577537 | 6/1959 | Canada . |
| 691314 | 7/1964 | Canada . |
| 692455 | 8/1964 | Canada . |
| 788050 | 2/1968 | Canada . |
| 850863 | 9/1970 | Canada . |

OTHER PUBLICATIONS

Letter from Steeler Inc. (Matt Surowiecki) to Canadian Steel Manufacturing dated Jun. 3, 1995.

PRO●BEAD The Ultimate Drywall Corner Bead! The Synkoloid Company of Canada, 11105 Bridge Street, Surrey, B.C. V3V 3V2.

CSM Bluenose™Paper/Metal Drywall Trims, 10022–29 Avenue, Edmonton, Alberta T6W–1A2, Mar. 1994.

*Primary Examiner*—Carl D. Friedman
*Assistant Examiner*—Aimee E. McTigue
*Attorney, Agent, or Firm*—Brinks Hofer Gilson & Lione

[57] ABSTRACT

An approved corner bead for drywall construction having a paper layer bonded to an exterior surface of a formed metal or plastic core. The paper is impregnated with a latex prior to affixing it to the core. The uniformly impregnated paper provides improved protection against adverse abrasion at all levels of thickness of the paper. An improved method for covering joints formed between abutting sheets of drywall involves spreading a bonding layer of joint compound, embedding the paper strip in that compound, applying an exterior layer of compound, and sanding the exterior layer so as to provide a smooth and continuous surface between the drywall sheets.

18 Claims, 5 Drawing Sheets

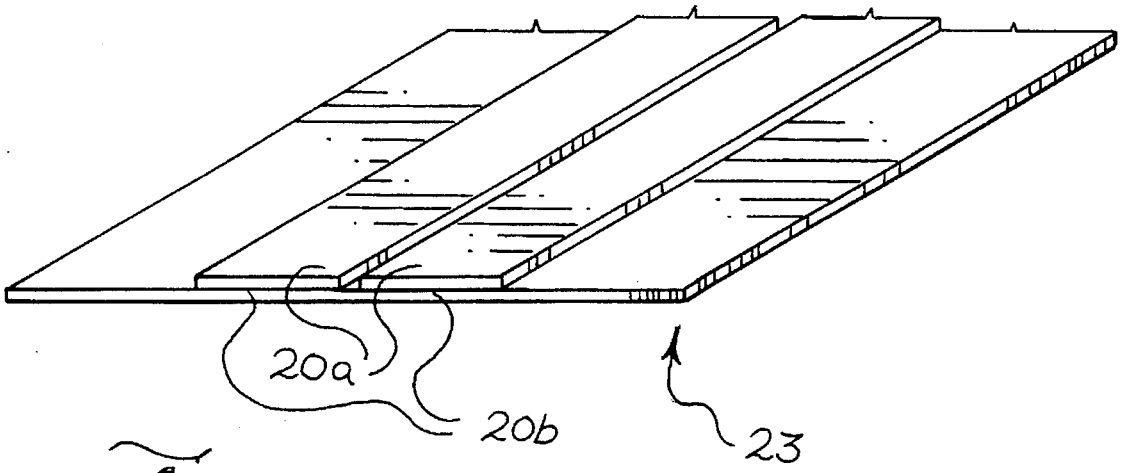
Fig. 8
Fig. 9
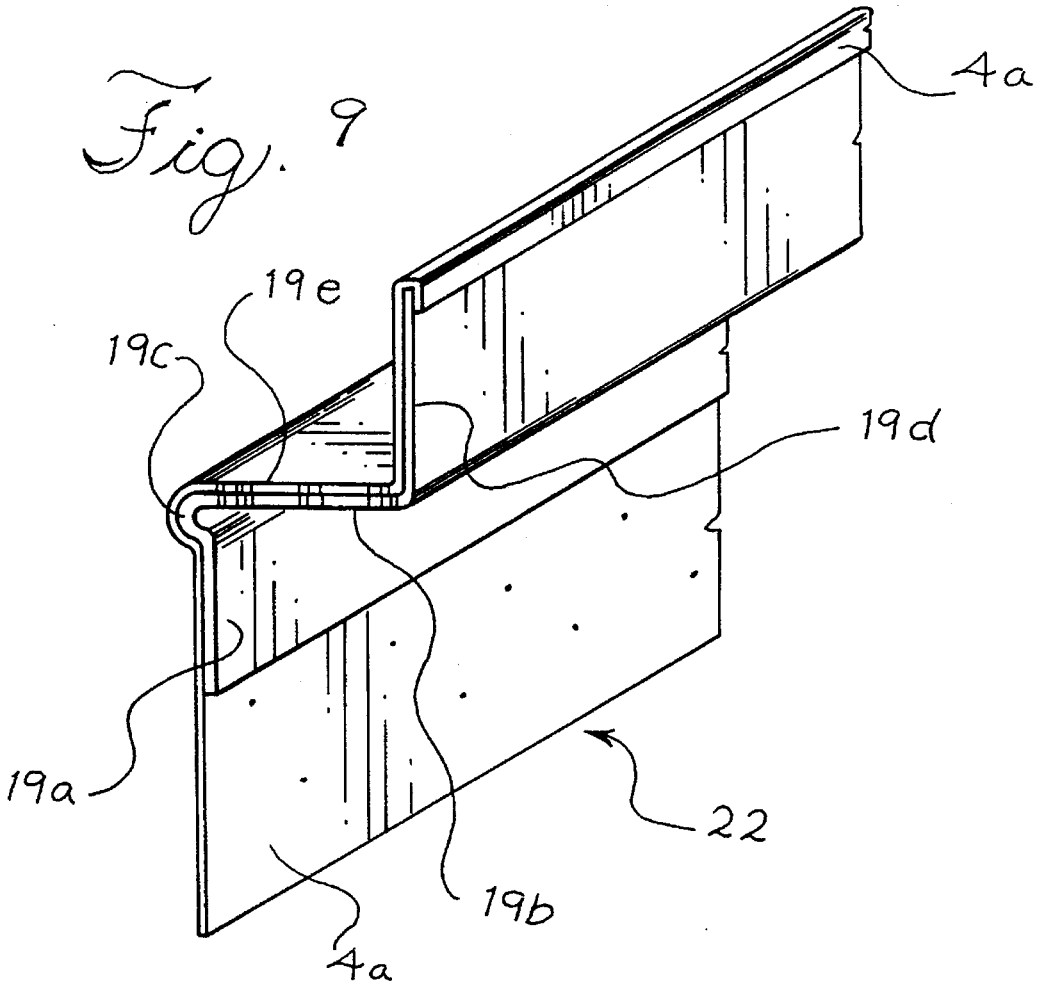

PAPERBEAD FOR PROTECTING DRYWALL CORNERS

BACKGROUND OF THE INVENTION

The present invention relates to drywall corner beads, particularly drywall corner beads having an outer paper layer. Current building construction techniques frequently call for the use of drywall sheets, otherwise called wallboard, to form the surfaces of interior walls. Sheets of drywall are made by encasing sheets of plaster with heavy construction paper. The paper provides extra strength and resistance to tearing and prevents crumbling of the enclosed plaster. The sheets of drywall are typically produced in sizes of four feet by eight feet or four feet by twelve feet. These sheets can be installed intact or can be cut to custom fit specific interior wall sizes. When cut, the inner plaster is exposed and is particularly vulnerable to crumbling or other damage unless the severed edges can be protected. An exposed corner, exterior or interior, formed by two interfacing drywall sheets not in the same plane is also susceptible to damage. Damage can be particularly severe when these corners involve cut or exposed edges. To overcome this vulnerability to injury and further reinforce the exposed corner formed by two interfacing drywall sheets, a drywall corner bead will generally be installed at that corner. The corner being reinforced can be either an interior or exterior corner.

Two types of drywall corner beads are typically used in reinforcing drywall corners, a paper faced bead, or paperbead type, and a non-paper faced bead, or nail-on type. Both the paperbead type and the nail-on type typically include a strip of metal formed or extruded into a desired shape, although molded plastic can also be used. One common example involves forming the metal strip into a core shape having two flanges and a center rib positioned between them. This form of corner bead will be called a rib-type of corner bead. Another common type of corner bead has two flanges and a larger curved portion or bullnose positioned between them. This type of corner bead will be called a bullnose corner bead. A third type of corner bead is an L-shaped type having one flange longer than the other and an offset rib between the flanges. Other types of corner beads include a J-shaped type, a splay-bead type, and a shadow-mold type.

Nail-on corner beads are attached to drywall by driving nails through the flanges, securing the drywall trim with the heads of the nails. A joint compound is then applied to cover the flanges and nail heads. The compound is sanded and feathered to provide a smooth and continuous surface from the drywall surface to the center rib of the formed metal strip.

Paperbeads provide several advantages over nail-on corner beads. For instance, both paint and joint compound adhere significantly better to the surface of a paperbead than to the exposed metal surface of a typical nail-on corner bead. Moreover, paint applied directly to a metal surface is easily chipped after drying. Drywall corners covered with nail-on corner beads are also more susceptible to cracking along the edges of the flanges. Thus, a paperbead provides a better surface for paint adhesion and helps reduce plaster cracking.

Paperbeads differ from nail-on type corner beads in several respects. First, the paperbead has a paper strip attached to an outer surface of the formed metal or plastic core previously discussed. Generally, portions of the paper strip extend beyond the edges of the metal or plastic core forming wings. The paperbead is attached to drywall corners by applying a joint compound to the drywall surface and embedding the formed metal strip and the paper wings in the compound. A second, exterior layer of joint compound is subsequently applied on top of the paperbead and allowed to dry. This exterior layer of joint compound is then sanded and feathered to form a smooth and continuous surface between the drywall and the corner bead. The steps of applying, sanding and feathering the exterior layer of joint compound can be repeated until a smooth surface is created. Throughout this process, the portion of the paper strip covering the corner bead, i.e. the center rib, the bullnose, or the offset rib, is left exposed or uncovered by joint compound.

The paper surface left exposed on a typical paperbead may be scuffed, or completely removed during the sanding and feathering process, thus exposing the metal surface beneath. Scuffing makes it more difficult to later obtain a smooth painted surface at the corner bead because the paper becomes frayed or fuzzy. Also, as stated previously, paint does not adhere as easily to the exposed metal surfaces. Therefore, paint applied to any exposed metal surface will be more easily chipped after it dries. Moreover, a scuff in the paper surface produces a break in the line of the corner bead and reduces the aesthetic benefits of having such a bead.

Joint tape made from paper strips is also used to cover the joint between two abutting sheets of drywall. The joint tape is applied to a thin layer of joint compound covering the joint, covered with an exterior layer of joint compound and sanded and feathered to form a smooth and continuous surface. As with corner beads, the joint tape can be subjected to abrasive contact that can scuff and tear the joint tape, making it difficult to obtain a smooth surface for painting.

To overcome the problems of scuffing, some paperbeads provide a surface coating at the exposed center portion of the corner bead to improve the paper's resistance to abrasion and avoid the problems caused by scuffing. This type of surface coated paperbead is disclosed in U.S. Pat. No. 5,131,198. A surface coating, however, only provides extra resistance to abrasion at the outer surface of the paper strip. If this coating is penetrated or removed by the sanding process, the underlying paper is exposed and is again made susceptible to scuffing. Consequently, the problems of paint adhesion, unsmooth surface finishes and paint chipping are not avoided. Moreover, the application of a surface coating at a particular location involves an additional manufacturing step thereby increasing the cost of making the product.

Therefore, in view of the above it is an object of the present invention to provide an arrangement wherein the paperbead is resistant to abrasion without the need for a coating.

SUMMARY OF THE INVENTION

The present invention provides an improved paperbead that eliminates the need to provide a localized surface coating while immunizing any and all exposed paper to scuffing or other abrasive damage. In accordance with present invention, the improved paperbead includes an elongated core having an outer surface. A paper strip is bonded to the outer surface of the core. The paper strip is made from a stock paper impregnated with a latex to a relatively uniform concentration throughout its thickness.

The paper strip discussed herein maintains a uniform and increased strength throughout its thickness, thereby making it resistant to scuffing even if its outer layers are removed by sanding or other abrasive contact. This uniform strength is obtained by uniformly penetrating the entire thickness of the paper with a latex. In a preferred embodiment, the paper strip includes a stock paper impregnated with a latex which is cross-linked. The resulting paper is substantially stronger than papers currently used in drywall corner beads. Furthermore, the increased resistance to abrasion is a property of the paper itself, rather than just a localized shield as provided by surface coatings. Therefore, even if the surface of the paper strip is sanded away, the inner layers continue to resist abrasion. A smooth surface is therefore maintained as the paper strip resists scuffing. The paper strip also provides an excellent surface for paint adhesion.

The present invention also provides a method for joining abutting sheets of drywall by utilizing the paper strip disclosed herein as joint tape. First, the paper strip is applied to a layer of joint compound, such as joint cement or spackle. A second layer of joint compound is then applied, covering the outer surface of the paper strip. Excess joint compound is removed and the compound is allowed to dry. The joint compound is then sanded and feathered to form a smooth and continuous surface between the abutting sheets of drywall. Due to its increased strength properties, the paper strip is thinner than other currently available joint tapes. Consequently, the installation process requires less joint compound. As a result, the joint compound dries faster and less sanding is required to finish the joint. The paper strip which forms the joint tape can be subjected to adverse abrasion during the sanding process. The added strength of the paper strip prevents it from being scuffed by this adverse abrasion at all levels of the paper's thickness.

BRIEF DESCRIPTION OF DRAWINGS

FIG. 8 is a perspective of a preferred embodiment of the invention showing a splay-bead type of paperbead.

FIG. 9 is a perspective of a preferred embodiment of the invention showing a shadow-mold type of paperbead.

DETAILED DESCRIPTION OF THE PRESENTLY PREFERRED EMBODIMENTS

Figure 1:
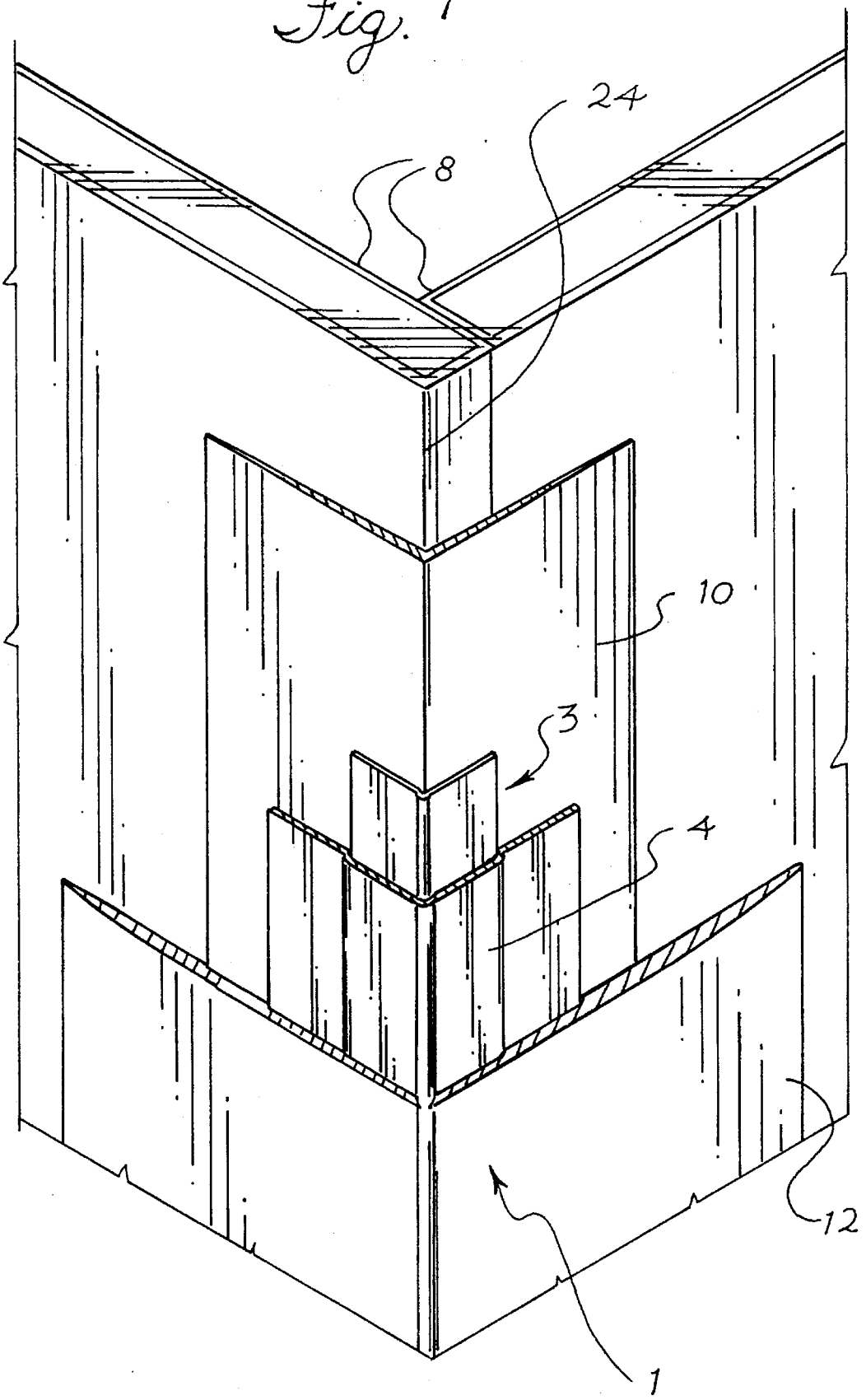
FIG. 1 is a perspective of an exterior corner with a preferred embodiment of the invention applied thereto and with portions broken away and in section.
Figure 2:
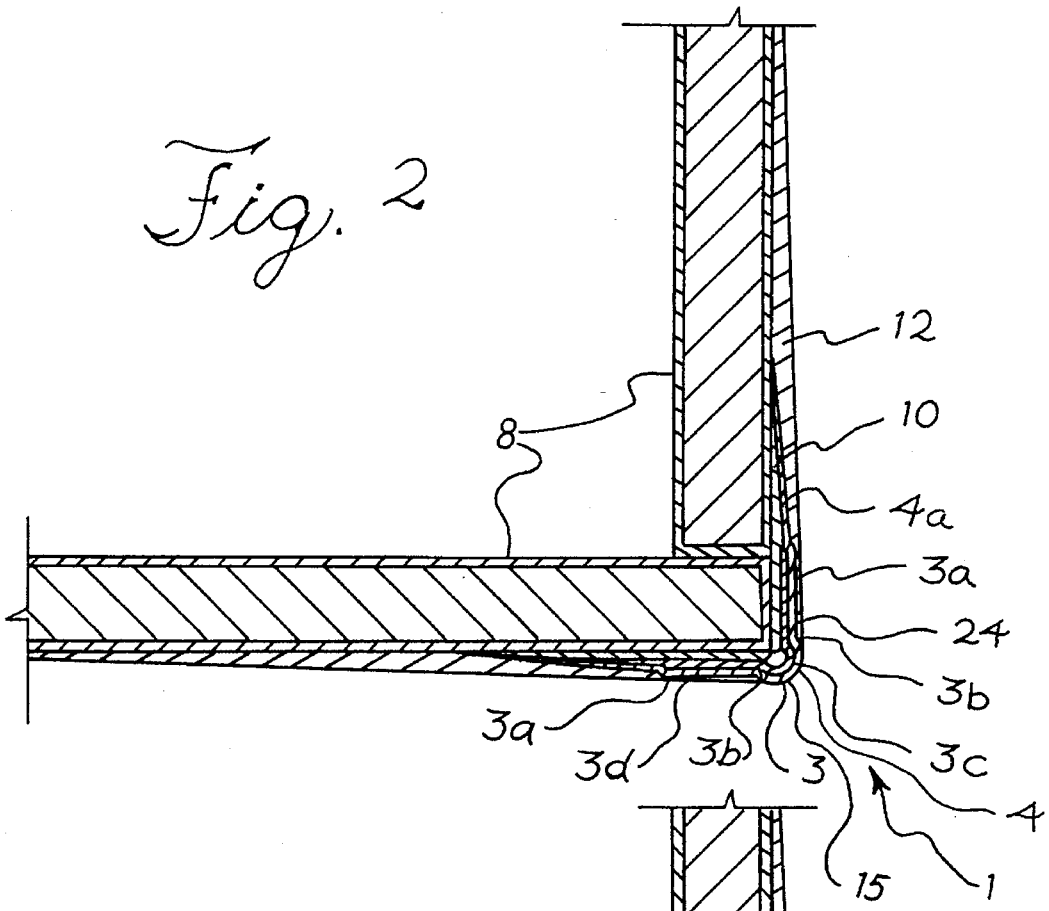
FIG. 2 is a preferred embodiment of the invention showing a cross section through an exterior corner with a rib type of paperbead applied thereto.

Referring now to the drawings in detail, and more particularly to FIGS. 1 and 2, a rib-type embodiment of the invention is illustrated. A paperbead 1 is shown covering an exposed drywall corner 24 formed by two sheets of drywall 8. The paperbead 1 has an elongated core 3 and a paper strip 4 bonded to the core as shown in FIGS. 1 and 2. The core 3 is preferably made out of galvanized steel which meets or exceeds ASTM 525 zinc coating specifications. However, other materials such as plastic can function as the core element. In an exemplary embodiment, the core 3 has a thickness of about 0.012 to 0.013 inches thickness. In the rib-type embodiment, the core 3 is roll formed into a rib shape having flanges 3*a*, a center rib 3*c* and a pair of shoulders 3*b* connecting the center rib 30*c* and the flanges 3*a*. The core 3 also has an outer surface 3*d*. The flanges 3*a* are commonly positioned at an angle of ninety degrees relative to each other, but other angular variations may be utilized to accommodate the relative positioning of the drywall sheets 8 and/or the desired shape of the corner. In the rib-type embodiment shown in FIGS. 1 and 2, the flanges 3*a* are about 1 inch wide. The center rib 3*c* is generally about 0.0625 inches high and 0.125 inches wide.

Figure 3:
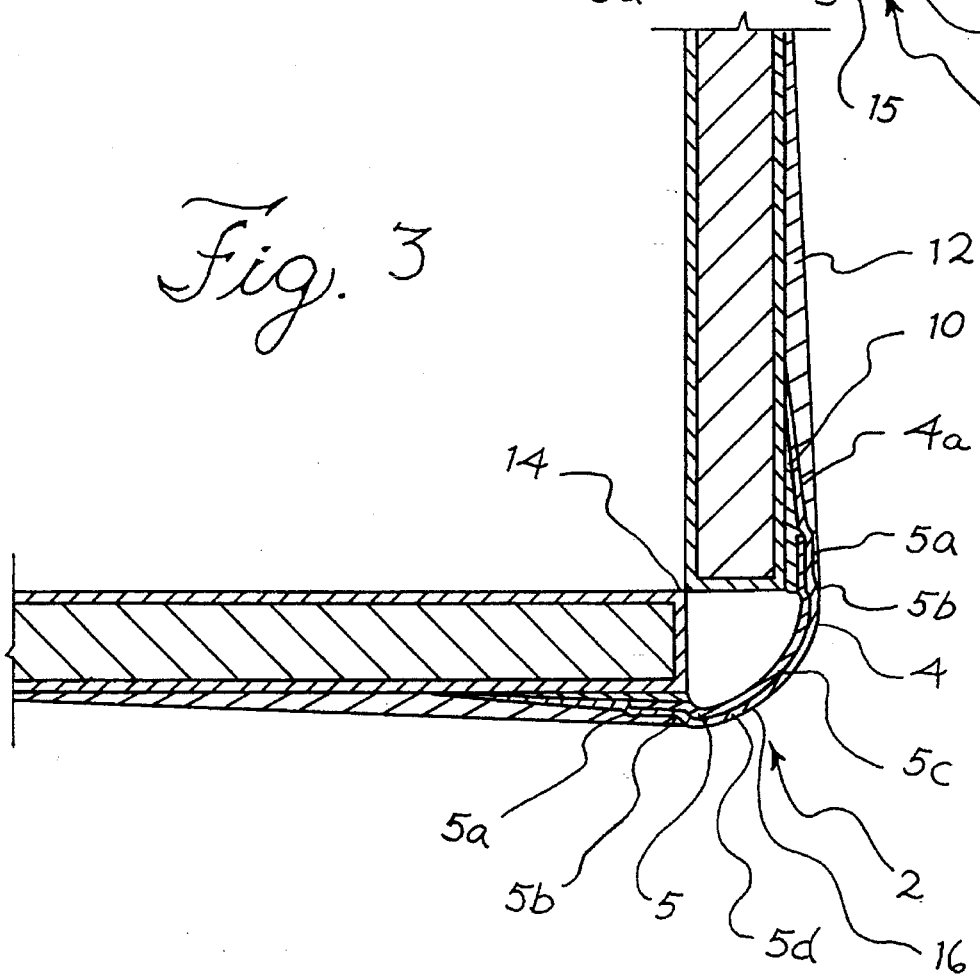
FIG. 3 is a preferred embodiment of the invention showing a cross section through an exterior corner with a bullnose type of paperbead applied thereto.
Figure 4:
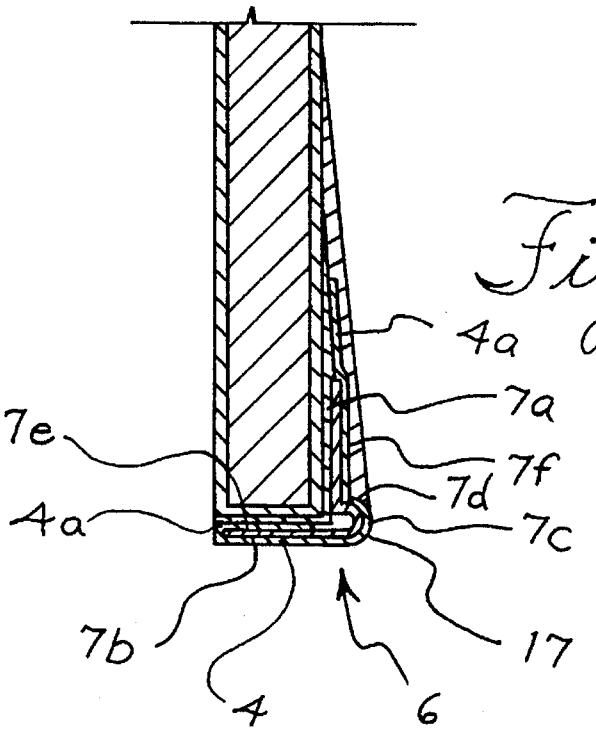
FIG. 4 is a preferred embodiment of the invention showing a cross section through a corner with a L-shaped type of paperbead applied thereto.
Figure 5:
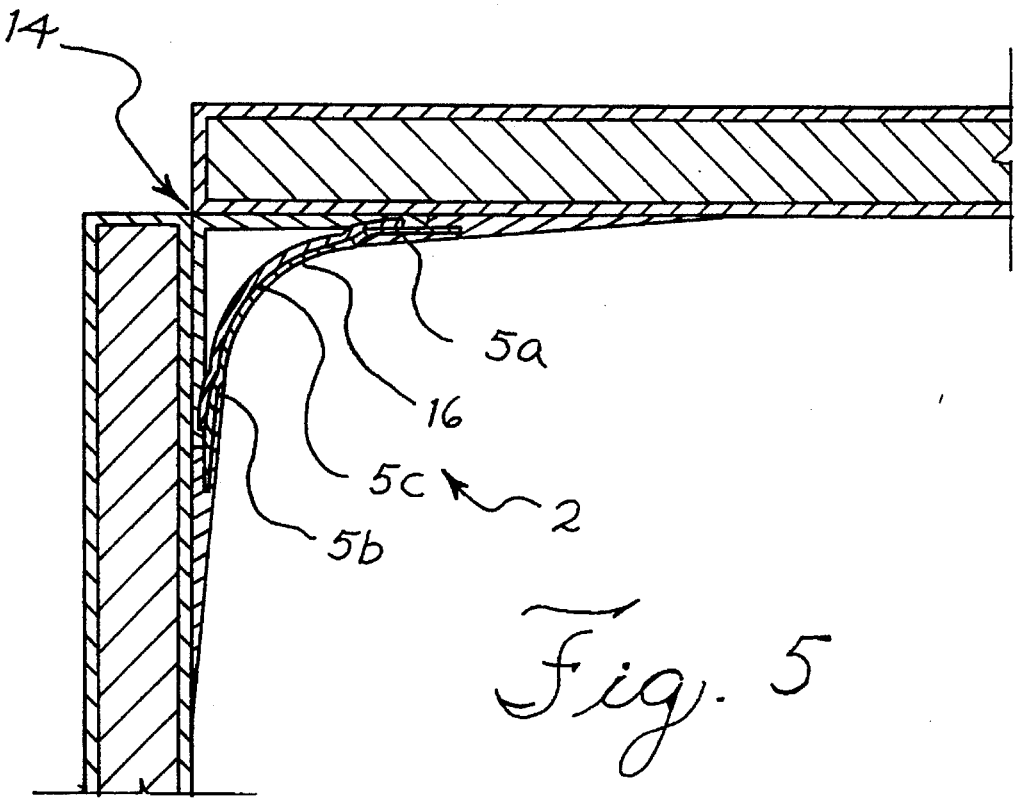
FIG. 5 is a preferred embodiment of the invention showing a cross section through an interior corner with a bullnose type of corner bead applied thereto.

The paperbead can be used to protect exterior corners, as shown in the embodiments of FIGS. 1, 2, 3 and 4, or to protect interior corners as shown in the FIG. 5 embodiment. For example, FIGS. 3 and 5 illustrate, respectively, an exterior and interior bullnose embodiment of the invention.

A bullnose paperbead 2 has a pair of flanges 5*a*, a bullnose 5*c*, a pair of shoulders 5*b* and an outer surface 5*d*. The outer surface 5*d* is defined as that surface facing away from the corner 14, independent of whether that outer surface forms a concave or a convex surface as shown in FIGS. 3 and 5. The flanges 5*a* are generally about 1 inch wide and are positioned, in this embodiment, at an angle of ninety degrees relative to one another. Other angular variations can be implemented. The radius of the bullnose 5*c* is typically in the range of about ¾ inches to 1½ inches. In the preferred embodiment shown, each of the shoulders 5*b* is about 0.125 inches wide and has a drop of 0.0625 from the surface of the bullnose 5*c* to the surface of the flange 5*a*.

A third embodiment of the paperbead is the L-shaped paperbead shown in FIG. 4. In this embodiment, the core 7 has a long flange 7*a*, a short flange 7*b*, an offset rib 7*c*, a shoulder 7*d* positioned between the offset rib 7*c* and the long flange 7*a*, and an outer surface 7*f*. In this embodiment, the long flange 7*a* is about 1½ inches to 2 inches long, while the short flange 7*b* is about ¾ inches long. The long flange 7*a* is positioned in this embodiment at about 90 degrees to the short flange 7*b* forming an L-shape. In an exemplary embodiment, the offset rib 7*c* is about 0.0625 inches high and about 0.125 inches wide.

Figure 7:
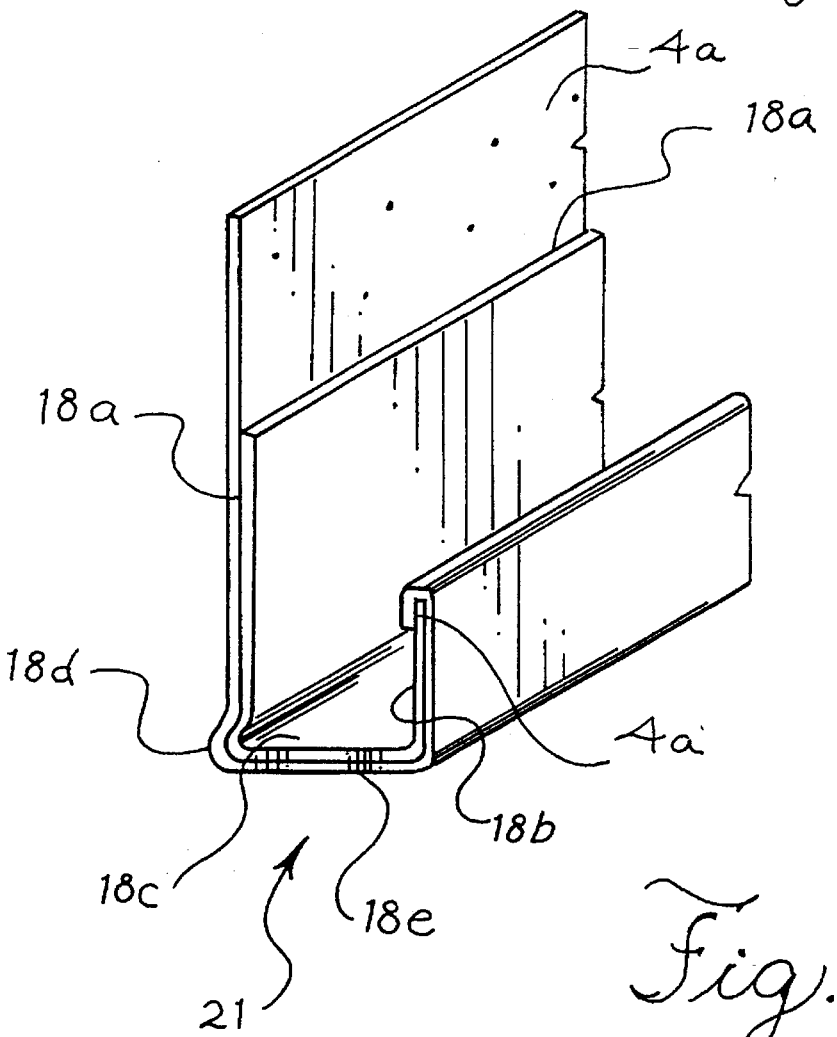
FIG. 7 is a perspective of a preferred embodiment of the invention showing a J-shaped type of paperbead.

A fourth embodiment of the paperbead is the J-shaped paperbead 21 shown in FIG. 7. In this embodiment, the core 18 has a long flange 18*a*, a short flange 18*b*, and/a center portion 18*c* positioned between the flanges. The core 18 also has an outer surface 18*d*. The long flange 18*a* is typically about 1 inch long. The short flange 18*b* is typically about ½ inches long. The center portion 18*c* is typically about ⅜ inches to ⅝ inches wide. An offset rib 18*d* is also shown in this embodiment as positioned between the center portion 18*c* and the long flange 18*a*. However, the offset rib can also be positioned between the center portion 18*c* and the short flange 18*b*, positioned between the center portion 18*c* and the short flange 18*b* and the long flange 18*a*, or excluded all together. In an exemplary embodiment, the center rib 18*d* is about 0.0625 inches high and about 0.125 inches wide.

A fifth embodiment of the paperbead is the shadow-mold paperbead 22 shown in FIG. 9. In this embodiment, the core 19 has a first flange 19*a*, a second flange 19*d*, a center portion 19*b*, and an offset rib 19*c*. The core 19 also has an outer surface 19*e*. The first flange 19*a* extends from the offset rib 19*c* forming an angle of about 90°. The center portion 19*b* is positioned between the offset rib 19*c* and the second flange 19*d*. The second flange 19*d* extends from the center portion 19*b* at an angle of about 90° in a direction opposite from the first flange 19*a*. In an exemplary embodiment, the flanges 19*a* and 19*d* are generally about ⅜ inches to 1 inch in length, but are not necessarily of equal length. The center portion 19*b* is about ⅜ inches to 1 inch in width.

A sixth embodiment is the splay-bead paperbead 23 shown in FIG. 8. In this embodiment, the core 20 has two strips 20*a* and an outer surface 20*b*. In an exemplary embodiment, the strips 20*a* are about ½ inches to ¾ inches in width.

Drywall paperbeads typically include the process of bonding a paper strip 4 to the outer surface 3*d* of the core element as shown in FIG. 2. In the rib-type embodiment, the paper strip 4 typically extends beyond the edge of each of the core flanges 3*a* about 1 inch to form a pair of wings 4*a*. In making the L-shaped paperbead 6, the wing 4*a* extending beyond the short flange 7*b* is wrapped around the flange and bonded to an inner surface 7*e* of the short flange 7*b*. In the splay-bead paperbead 23 embodiment of the invention, the two metal strips 20*a* are bonded to the paper strip leaving a space between them. The space may be, for example, 0.050 inches. This spacing allows the strips 20*a* to rotate relative to each other. The strips 20*a*, therefore, can be positioned at different angles relative to each other. Accordingly, the splay-bead paperbead 23 can accommodate a variety of wall angle combinations. In an exemplary embodiment, the paper strip 4 extends beyond the metal strips 20*a* about ¾ inches to 1¼ inches.

In making the J-shaped paperbead 21, the paper strip 4 can be bonded to the outer surface 18*d* of the core 18 in a number of ways. For instance, in the embodiment shown in FIG. 7, one wing 4*a* extends beyond the long flange 18*a* about ¾ inches and a second wing 4*a* wraps around the short flange 18*b* about 0.125 inches. In other J-shaped paperbead 21 embodiments, the wings 4*a* may extend beyond or wrap around the long flange 18*a* and short flange 18*c* in any number of combinations. In yet another J-shaped paperbead 21 embodiment, the paper strip 4 ends at the edge of the flanges 18*a* and 18*b*. In the shadow-mold paperbead 22 embodiment, one wing 4*a* extends beyond the first flange 19*a* about ½ inches to 1 inch. The second wing 4*a* wraps around the second flange 19*d* about 0.125 inches as shown in FIG. 9.

The paper strip 4 is made from a stock paper, preferably a softwood and hardwood fiber Kraft stock paper commonly used in the wall covering industry. However, synthetic fiber products can also be used. To obtain high wet and dry strength properties, the stock paper is impregnated with a latex. However, other strengthening compounds may also be used to impregnate and strengthen the paper. Generally, a latex consists of a stable colloidal dispersion of a polymeric substance in an aqueous medium. There are a large number of commercial latices. For example, rubber latices, including a styrene-butadiene rubber, and resin latices, including acrylic resins, may be used to impregnate the stock paper. In a preferred embodiment, the stock paper is impregnated to about 5% to 15% based on the weight of the paper. The stock paper is uniformly penetrated with the latex, resulting in the same concentration of latex throughout the paper. In addition, the latex is cross-linked. As a result, the paper has a good internal bond and exhibits excellent Z-direction tensile strength properties. Cross-linking can be accelerated by heating or superheating the latex impregnated paper. One suitable type of paper, designated WALLSTRIP™ and produced by Thorold Specialty Papers (formerly Noranda Forest Recycled Papers), of Etobicoke, Ontario, Canada, is a latex impregnated paper superheated to 300° F. The process of impregnating the paper and cross-linking the latex does not increase the thickness of the paper yet increases its strength properties and its ability to resist abrasion. The paper also provides an excellent surface for paint adhesion. The thickness of the paper may be generally about 0.004 to 0.010 inches. In a preferred embodiment, the paper is about 0.005 inches in thickness.

Most types of metal paperbeads, exterior and interior, are produced by feeding a roll of paper strip and a flat metal strip into a paperbead rollformer. The metal strip is roll formed into its respective core shape, whether it be a bullnose type, a center rib type, an L-shaped type or any other type of corner bead. Metal cores can also be made by extrusion. As noted previously, plastic cores can also be utilized. In an exemplary embodiment, the paper strip is covered with a hot melt glue. For example, several suitable fast-setting hot melt glues are available from Nacan Products Limited of Canada. This type of glue is typically a formulated synthetic emulsion adhesive. The paper strip is then bonded to the outer surface of the core by applying pressure to the core and the paper strip with a series of pressure rolls to ensure an even bond. The paperbead is then cut to the desired length.

As shown in FIGS. 1, 2, and 3, a paperbead 1, 2 is installed by first applying a thin bonding layer 10 of joint compound or joint cement of about 4 inches to 4½ inches wide to the leading edges of two interfacing drywall sheets 8. The corner beads 1, including the core 3, 5 and the paper wings 4*a* are then firmly embedded in the bonding layer 10. Excess joint compound is removed by wiping the paper strip surface with a finishing knife. An exterior layer 12 of joint compound is applied to the top of the paperbead extending about 8 inches inward on the drywall sheet 8, leaving only a paper covered center rib 15 or a paper covered bullnose 16 exposed. The exterior layer 12 of joint compound is allowed to dry and is then sanded and feathered to produce a smooth surface between the drywall sheet 8 and the paper covered center rib 15 or the paper covered bullnose 16. J-shaped paperbeads 21, shadow-mold paperbeads 22 and splay-bead paperbeads 23 are installed in a similar fashion.

The paper strip is well suited to prevent scuffing and other damage during this sanding and feathering process. The uniform strength of the paper strip provides protection against scuffing or tearing even when the surface of the paper is penetrated or damaged. This provides improved protection over surface coated papers while avoiding the extra manufacturing step required by coating the paper. The process of adding and sanding the exterior layer 12 of joint compound can be repeated as needed to produce a smooth surface. After sanding and feathering, the paper covered center rib 15 and the paper covered bullnose 16 remain exposed or uncovered by joint compound. The exterior layer 12 of joint compound and the exposed paper covered center rib 15 and paper covered bullnose 16 provide an excellent surface for paint adhesion.

As shown in FIG. 5, an interior paperbead is also installed by embedding a paperbead 2 and paper wings 4*a* in a bonding layer 10 of joint compound. After drying, an exterior layer 12 of joint compound is applied, sanded and feathered. Interior bullnose paperbeads 2 will have an exposed paper covered bullnose 16. As with exterior corner beads, the paper's added strength helps resist adverse scuffing at all levels of the paper.

FIG. 4 shows a L-shaped paperbead 6 installed by applying a thin bonding layer 10 of joint compound to a drywall sheet 8 and the exposed end 8*a* of the sheet. The L-shaped paperbead 6 is embedded in the bonding layer 10. An exterior layer 12 of joint compound is then applied to cover a paper covered long flange 7*a* and wing 4*a*. This layer is sanded and feathered to provide a smooth and continuous surface between a paper covered offset rib 17 and the drywall sheet 8.

Figure 6:
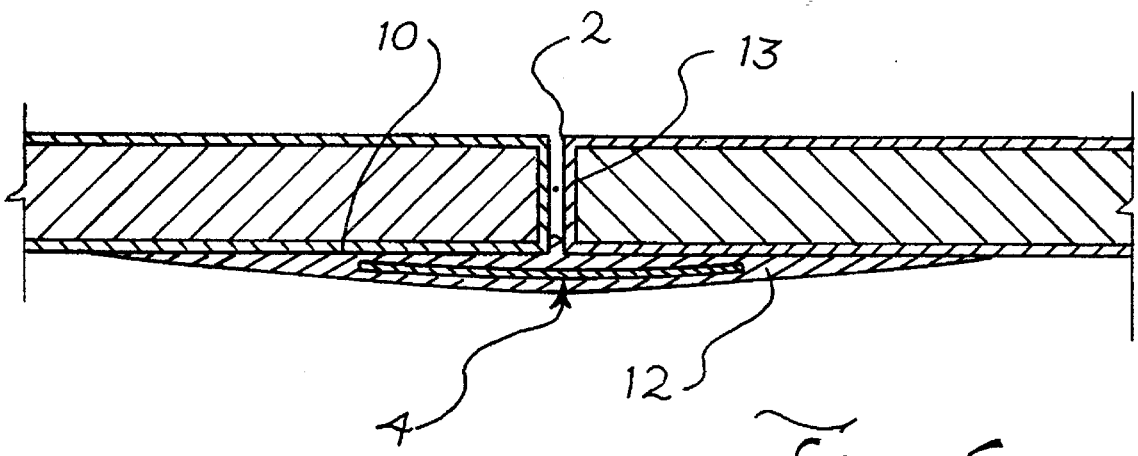
FIG. 6 is a cross section of two abutting sheets of drywall and a paper strip applied thereto.

As shown in FIG. 6, a paper strip 4, made as described above, can also be used as a joint tape to cover a joint 13 formed between a pair of abutting drywall sheets 8. To cover and strengthen the joint 13, a thin bonding layer 10 of joint compound, such as joint cement or spackle, is spread about 2 inches wide on each drywall sheet 8. A paper strip 4 is applied to the bonding layer 10. An exterior layer 12 of joint compound is then applied on top of the paper strip 4. After drying, the exterior layer 12 of joint compound is sanded and feathered to provide a smooth and continuous surface between the sheets of drywall 8. This method of joining abutting sheets of drywall provides added resistance to abrasion during the sanding and feathering process, thereby avoiding a scuffed surface. In a preferred embodiment, the paper's thickness is about 0.005 inches. As other papers currently used for this application are about 0.008 inches, less joint compound is required to finish the joint. Because a thinner exterior layer 12 of joint compound is applied, the joint compound dries faster and the installation is expedited. Furthermore, less sanding and feathering is required to finish the joint.

Although the present invention has been described in detail by way of illustration and example, various changes and modifications may be made without departing in any way from the spirit of the invention and scope of the appended claims. In addition, many of the features and dimensions portrayed in the drawings have been exaggerated for the sake of illustration and clarity.

We claim:

1. A drywall paperbead comprising:

an elongated core having an outer surface; and a paper strip bonded to said outer surface of said core, said paper strip comprising a stock paper impregnated with a latex to a relatively uniform concentration throughout its thickness, whereby said paper strip is made resistant to abrasion and scuffing throughout its entire thickness.

2. A drywall paper bead according to claim 1 wherein said latex is cross-linked.

3. A drywall paperbead according to claim 1 wherein said latex impregnates said stock paper from 5% to 15% by weight.

4. A drywall paperbead according to claim 1 wherein said latex comprises an acrylic resin.

5. A drywall paperbead according to claim 4 wherein said acrylic resin is cross-linked.

6. A drywall paperbead according to claim 1 wherein said paper strip is 0.004 to 0.010 inches thick.

7. A drywall paperbead according to claim 1 wherein said core has a pair of flanges, said paper strip extends beyond said flanges to form a pair of wings.

8. A drywall paperbead according to claim 7 wherein said core further comprises a center rib and two shoulders interposed between said flanges, said shoulders connecting said center rib and said flanges.

9. A drywall paperbead according to claim 7 wherein said core further comprises a bullnose and a pair of shoulders interposed between said flanges, said shoulders connecting said bullnose to said flanges.

10. A drywall paperbead according to claim 7 wherein said core further comprises a shoulder and an offset rib, said flanges comprising a long flange and a short flange, said short flange having an inner surface, said shoulder connecting said long flange and said offset rib, said wing extending beyond said short flange bonded to said inner surface of said short flange.

11. A drywall paperbead according to claim 1 wherein said core further comprises a center portion, an offset rib, a first flange and a second flange, said center portion positioned between said offset rib and said second flange, said second flange extending from said center portion, said first flange extending from said offset rib in a direction opposite said second flange.

12. A drywall paperbead according to claim 1 wherein said core further comprises a center portion, a short flange and a long flange, said center portion positioned between said long flange and said short flange to form a J-shape.

13. A drywall paperbead according to claim 1 wherein said core further comprises two strips, said strips positioned so as to form a space between them.

14. A dry wall paperbead according to claim 1 further comprising a formulated synthetic emulsion adhesive bonding said paper strip to said core.

15. A drywall paperbead comprising:

an elongated core having an outer surface; and a paper strip bonded to said outer surface of said core, said paper strip formed by impregnating a stock paper with a latex to a relatively uniform concentration throughout its thickness, whereby said paper strip is made resistant to abrasion and scuffing throughout its entire thickness.

16. A drywall paperbead according to claim 15 wherein said paper strip is further formed by cross-linking said latex.

17. A drywall paperbead according to claim 15 wherein said latex comprises an acrylic resin, said paper strip is further formed by cross-linking said acrylic resin.

18. A method for covering joints between abutting drywall sheets comprising:

applying a bonding layer of joint compound to two abutting drywall sheets;

applying a paper strip to said bonding layer, said paper strip made by impregnating a stock paper with a latex and crosslinking said latex;

applying an exterior layer of joint compound to cover said paper strip; and sanding and feathering said exterior layer to provide a smooth and continuous surface between said abutting drywall sheets, whereby said paper strip resists abrasion and scuffing during the sanding and feathering process.

* * * * *